US009214266B2

(12) United States Patent
Lee et al.

(10) Patent No.: US 9,214,266 B2
(45) Date of Patent: Dec. 15, 2015

(54) ELECTROMAGNETIC FORCE DRIVING DEVICE

(71) Applicant: Soonchunyang University Industry Academy Cooperation Foundation, Asan-si (KR)

(72) Inventors: HeeJoon Lee, Asan-si (KR); HakMin Kim, Asan-si (KR)

(73) Assignee: Soonchunyang University Industry Academy Cooperation Foundation, Asan-si (KR)

( * ) Notice: Subject to any disclaimer, the term of this patent is extended or adjusted under 35 U.S.C. 154(b) by 0 days.

(21) Appl. No.: 14/501,450

(22) Filed: Sep. 30, 2014

(65) Prior Publication Data

US 2015/0187483 A1 Jul. 2, 2015

(30) Foreign Application Priority Data

Dec. 27, 2013 (KR) ..... 10-2013-00165732

(51) Int. Cl.
*H01F 7/00* (2006.01)
*H01F 7/06* (2006.01)
*H01F 7/02* (2006.01)

(52) U.S. Cl.
CPC ..... *H01F 7/066* (2013.01); *H01F 7/0289* (2013.01)

(58) Field of Classification Search
CPC ..... H01H 53/015
USPC ..... 335/148, 229
See application file for complete search history.

(56) References Cited

U.S. PATENT DOCUMENTS 5,345,206 A * 9/1994 Morcos ..... H02K 41/0356 310/13
5,745,019 A * 4/1998 Renger ..... A61N 1/3925 335/222
6,373,675 B1 * 4/2002 Yamazaki ..... H01H 53/015 200/237
6,580,345 B2 * 6/2003 Akita ..... H01H 33/285 218/141
6,741,151 B1 * 5/2004 Livshitz ..... H01F 7/066 335/222
6,975,195 B2 * 12/2005 Rausch ..... H01F 7/066 335/220
7,924,127 B2 * 4/2011 Jeong ..... H02K 33/18 310/13
8,531,062 B1 * 9/2013 Eghbal ..... H02K 41/031 310/12.16
2006/0049901 A1 * 3/2006 Bottcher ..... H01F 7/066 335/229
2007/0075810 A1 * 4/2007 Iiduka ..... G01G 7/02 335/229
2011/0257626 A1 * 10/2011 Hunter ..... A61B 17/20 604/503

* cited by examiner

*Primary Examiner* — Alexander Talpalatski
(74) *Attorney, Agent, or Firm* — NSIP Law

(57) ABSTRACT

An electromagnetic force driving device having reduced size and weight, and easily changeable electromagnetic characteristics and holding force, is provided. The device includes: a first housing; a second housing installed under the first housing; a partitioning wall partitioning the first and second housings; a first mover installed on a top of the first housing; a coil unit installed at a lower portion of the second housing to be movable according to a direction of current supplied; a second mover including one end combined with the coil unit, and another end passing through the partitioning wall and connected to the first mover to operate the first mover according to a movement of the coil unit; an upper magnet installed in the first housing to maintain a predetermined position of the first mover; and a lower magnet arranged in the second housing to form a magnetic field at the coil unit.

7 Claims, 12 Drawing Sheets

ELECTROMAGNETIC FORCE DRIVING DEVICE

CROSS-REFERENCE TO RELATED APPLICATIONS

This application claims the benefit under 35 USC §119(a) of Korean Application No. 10-2013-00165732 filed on Dec. 27, 2013 in the Korean Intellectual Property Office, the entire disclosure of which is incorporated herein by reference for all purposes.

BACKGROUND OF THE INVENTION

1. Field of the Invention

The present invention relates to an electromagnetic force driving device, and more specifically, to an electromagnetic force driving device, in which the size and weight can be reduced by combining a magnetic substance and a coil unit through a connection pin inside thereof, and electromagnetic characteristics and a holding force can be easily changed by forming independent motion paths.

2. Background of the Related Art

Generally, a circuit breaker is installed at a sending end or a receiving end of a power transmission line to open and close a normal current when there is no failure in a power system and, in addition, to protect the power system and various power devices (loads) by blocking a fault current when a failure such as a short circuit or the like occurs.

Such a circuit breaker is classified into a Vacuum Circuit Breaker (VCB), an Oil Circuit Breaker (OCB), a Gas Circuit Breaker (GCB) and the like according to an extinguishing/insulating material.

When the circuit breaker blocks the fault current, arcs generated between two contacting points should be extinguished, and the gas circuit breaker is classified again into a Puffer type, a Rotating arc type, a Thermal expansion type, a Hybrid extinction type and the like according to a method of extinguishing the arcs.

In such a circuit breaker, an opening operation should be accomplished at a high speed in order to block the failure current and promptly recover insulation between electrodes, and, for example, a high voltage/extra high voltage (generally, 365 kv or higher) circuit breaker for power transmission has a stroke length (SL) of about 250 mm and requires a force and a speed as large as to complete the operation within an extremely short time of 45 ms (milliseconds).

Although a hydraulic or pneumatic actuator is chiefly used as a high voltage/extra high voltage circuit breaker at present, there is a problem in that such an actuator is very expensive as much as one third of a total price of the circuit breaker, and, in Korean, most of actuators are imported.

Furthermore, in such a hydraulic or pneumatic actuator, working fluid may be leaked according to changes in the temperature of surrounding areas, and since the actuator is configured of a lot of parts, it is worried that the actuator may not operate if any one of the parts is out of order.

Accordingly, studies on development of actuators for substituting hydraulic or pneumatic actuators are under progress, and a spring actuator (a spiral spring), a motor drive (a system for converting a rotation motion into a linear motion using a motor), and a permanent magnetic actuator (PMA) are representatively used as results of the studies.

However, since the spring actuator is a system for obtaining power by releasing a compressed force when needed while a spring is compressed, its manufacturing cost is low. However, it is disadvantageous in that reliability of an operation state is low since elastic force of the spring is inconsistent. Therefore, it is difficult to apply the spring actuator to a high voltage/extra high voltage in which extinction gas should be sprayed, and, in addition, probability of failing the cutoff will be very high.

In addition, although manufacturing cost of the motor drive is low compared with that of the hydraulic or pneumatic actuator, since it is still expensive and difficult to generate a high power, the motor drive can be used for a low voltage, but may not exhibit sufficient performance at a high or extra high voltage.

In addition, the PMA actuator is formed to operate a mover using an electromagnetic force caused by a magnetic force generated by a permanent magnet and a magnetic field generated by flowing current through a coil, and since the PMA actuator is advantageous in that it has a simple structure and a good actuating efficiency and a consistent and uniform operation can be expected, it is frequently used as an actuator for a low voltage circuit breaker recently.

However, since the PMA actuator is a system which should be driven by a magnetic force generated by a permanent magnet and a magnetic force generated by flowing current through a coil, a path for flowing the magnetic field should be prepared using a magnetic substance (an iron core), and, in addition, the driven mover also should be formed of a magnetic substance.

Accordingly, when the breaking capacity is increased and thus the actuator needs a more powerful force, more magnetic fields should be generated, and the magnetic substance also should be increased as much as to flow the magnetic fields without being saturated, and thus the burden on the size of the actuator is increased, and since magnetic flux densities excited at the permanent magnet and the coil are inverse proportional to the square of an air gap length, there is a limit in applying the PMA actuator to a high voltage or extra high voltage circuit breaker having a large contact gap of a breaking unit, and thus there is a problem in that when the PMA actuator is used for an extra high voltage, its size should be much bigger, and its weight is much heavier than that of a hydraulic or pneumatic actuator, and, in addition, manufacturing cost is also increased.

Recently, an actuator such as an electromagnetic circuit breaker or an Electro-Magnetic Force Driving Actuator (EMFA) have been proposed in Korea Patent Registration No. 10-0718927 (title of the invention: Actuator using electromagnetic force and circuit breaker using thereof) to maximize the actuating speed and force while having a small size and weight to solve the problems of the circuit breakers.

Such an electromagnetic circuit breaker is a kind of circuit breaker having a structure of providing inner and outer hollow containers formed of a magnetic substance, arranging inner and outer permanent magnets on the facing surfaces of the inner and outer containers, and arranging a coil and a mover of a non-magnetic substance operating together with the coil as one piece between the inner permanent magnet and the outer permanent magnet, and thus when a current is supplied to the coil, the coil and the mover linearly move in the axis direction between the inner permanent magnet and the outer permanent magnet by an electromagnetic repulsion force generated by the magnetic field of the inner and outer permanent magnets and the current density of the coil.

However, in such an electromagnetic circuit breaker (EMFA), since the coil is arranged inside the enclosed outer container, it is difficult to connect an electric wire inside the outer container to supply current to the coil.

In addition, although the wire is connected, since the connected wire moves in the axis direction according to the linear motion of the coil, there is a problem of open circuit since the moving speed of the coil is too high and thus the electric wire is fatigued by compression and tension.

In addition, since a conventional electromagnetic circuit breaker has a mover arranged inside the enclosed hollow inner and outer containers, a moving axis or a connection axis should be extended long from the mover in the axis direction in order to connect the mover to an external movement element, and, in addition, the length of the extension should be long enough to sufficiently secure a stroke distance of the mover.

In addition, since increase of the length leads to increase of the overall height occupied by the circuit breaker, and the number of the connection axis or the moving axis should be increased or a connection axis or a moving axis of a large diameter should be used considering strength of the connection axis or the moving axis, there is a problem in that the overall weight of the circuit breaker is increased.

In addition, since the conventional circuit breaker has a coil unit and a magnetic substance formed in one piece, there is a problem in that electromagnetic characteristics and a holding force for maintaining a top or bottom dead point state cannot be changed according to an installation environment.

SUMMARY OF THE INVENTION

Therefore, the present invention has been made in view of the above problems, and it is an object of the present invention to provide an electromagnetic force driving device, in which the size and weight can be reduced by combining a magnetic substance and a coil unit through a connection pin inside thereof, and electromagnetic characteristics and a holding force can be easily changed by forming independent motion paths.

To accomplish the above object, according to one aspect of the present invention, there is provided an electromagnetic force driving device comprising: a housing including a first housing having an open top and a groove unit formed in a length direction, a second housing installed under the first housing, a third housing installed under the second housing, and a partitioning wall for partitioning the first and second housings; a first mover installed on a top of the first housing to be movable in a vertical direction; a coil unit installed at a lower portion of the second housing so as to move either upwards or downwards by a repulsive force according to a direction of current supplied in a forward direction or a reverse direction; a second mover, one end of which is combined with the coil unit, and the other end of which passes through the partitioning wall to be connected to the first mover, to operate the first mover according to a movement of the coil unit; an upper magnet installed in the first housing to provide a magnetic force for the first mover to maintain a predetermined position; and a lower magnet arranged in the second housing in parallel to form a magnetic field at the coil unit.

In addition, the first housing according to the present invention includes a first motion path formed in the length direction to have a predetermined depth so that a portion of the first mover may be inserted and rested and an upper magnet installation groove in which the upper magnet is installed.

In addition, the upper magnet according to the present invention has a first magnetic substance installed at one side of a body of the upper magnet to form a magnetic path together with the first mover.

In addition, the second housing according to the present invention includes: a first non-magnetic substance installed between the partitioning wall and the lower magnet; and a second non-magnetic substance installed between the lower magnet and the third housing.

In addition, the electromagnetic force driving device according to the present invention further comprises: a supporting housing installed at a lower portion of the housing and having an open bottom and a groove unit formed in a length direction; a first supporting mover installed in the supporting housing to be movable in a vertical direction; a second supporting mover, one end of which is combined with the coil unit and the other end of which passes through the third housing 110*c* to be, connected to the first supporting mover, to operate the first supporting mover according to a movement of the coil unit; and a supporting magnet installed in the supporting housing to provide a magnetic force for the first supporting mover to maintain a predetermined position.

In addition, the supporting magnet according to the present invention further includes a first supporting magnetic substance installed at one side of a body of the supporting magnet to form a magnetic path together with the first supporting mover.

In addition, the first housing and the supporting housing according to the present invention are arranged such that the grooves thereof formed in the length direction are parallel or perpendicular to the length direction of the coil unit of the second housing.

The present invention is advantageous in that when an error occurs in a power distribution and transmission line, it can be promptly cut off, and the overall weight and size can be reduced by simplifying the structure of the electromagnetic force driving device by combining a magnetic substance and a coil unit through a connection pin inside thereof.

In addition, the present invention is advantageous in that electromagnetic characteristics and a holding force can be easily changed by forming independent motion paths for moving the mover and the coil unit.

DESCRIPTION OF SYMBOLS

Figure 1:
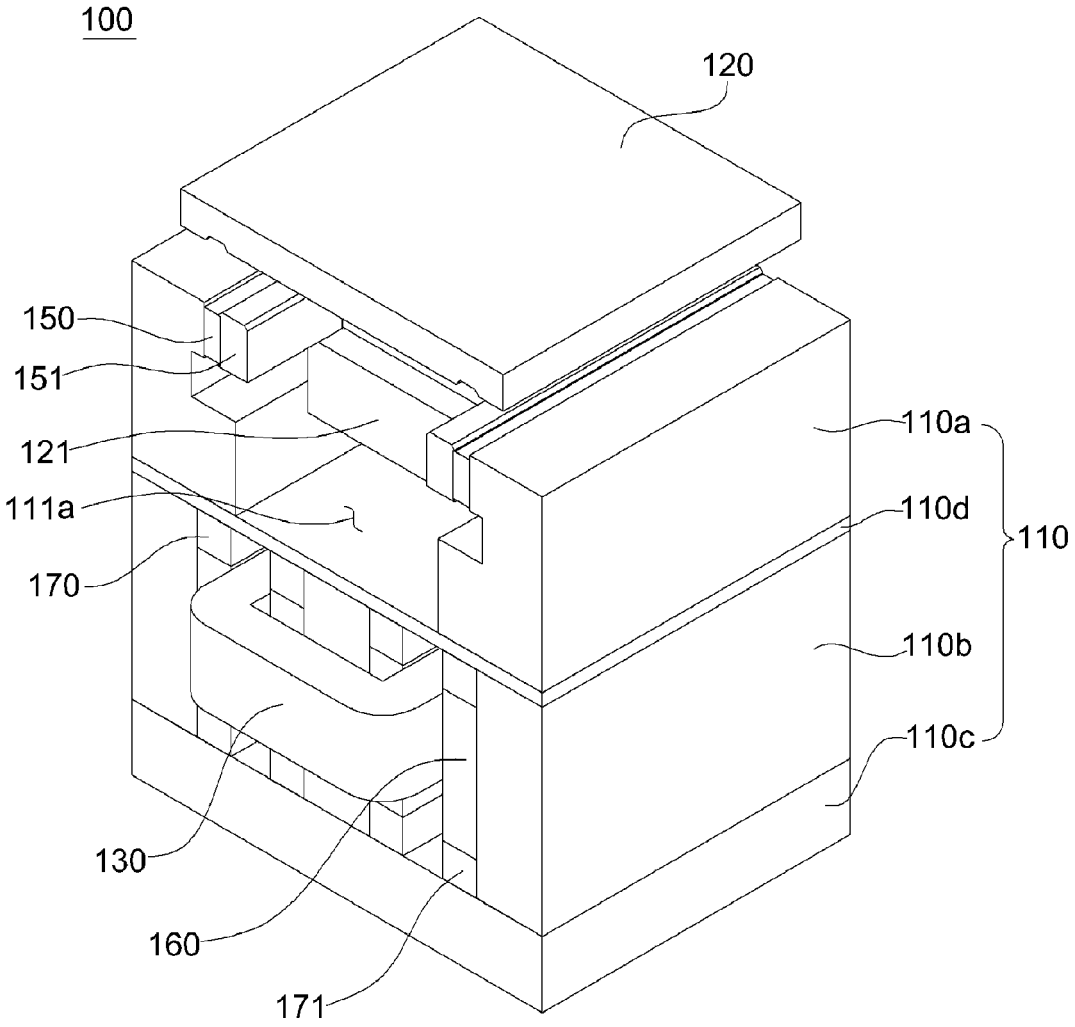
FIG. 1 is a perspective view showing a first embodiment of an electromagnetic force driving device according to the present invention.

100, 100', 300, 300': Electromagnetic force driving device
110, 110', 310, 310': Housing
120, 320: First mover
120', 320': First supporting mover
130, 330: Coil unit
140, 340: Second mover
140', 340': Second supporting mover
150', 350: Upper magnet
160, 360: Lower magnet
170, 370: First non-magnetic substance
171, 371: Second non-magnetic substance

DETAILED DESCRIPTION OF THE PREFERRED EMBODIMENT

Hereafter, preferred embodiments of an electromagnetic force driving device according to the present invention will be described in detail with reference to the accompanying drawings.

First Embodiment

Figure 2:
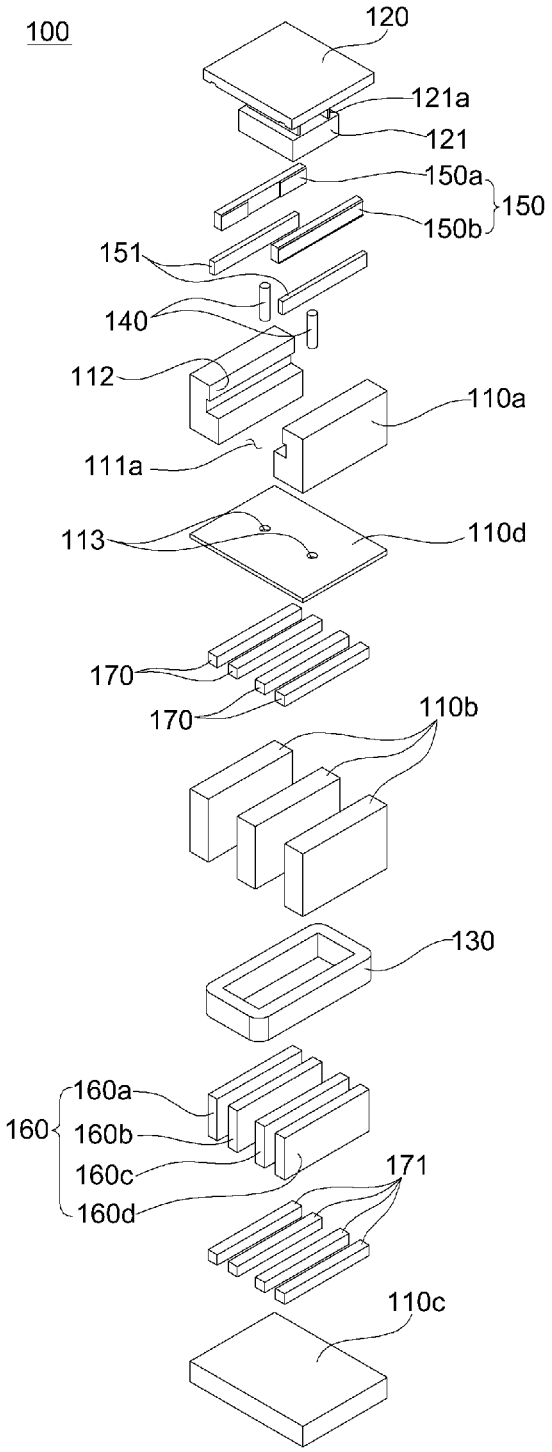
FIG. 2 is an exploded perspective view showing the configuration of the electromagnetic force driving device according to FIG. 1.
Figure 3:
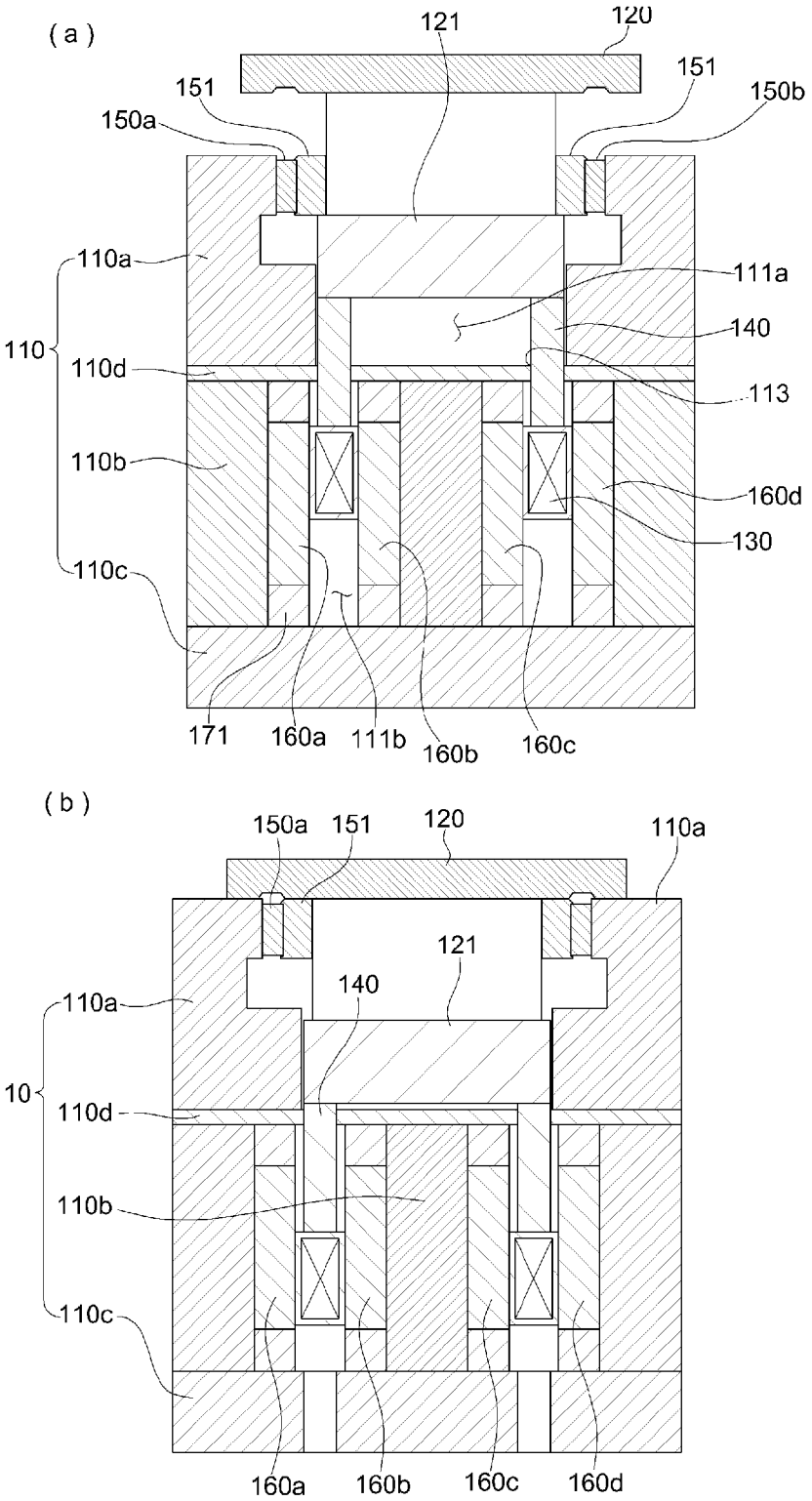
FIG. 3 is a cross-sectional view showing the structure and operation of the electromagnetic force driving device according to FIG. 1.
Figure 4:
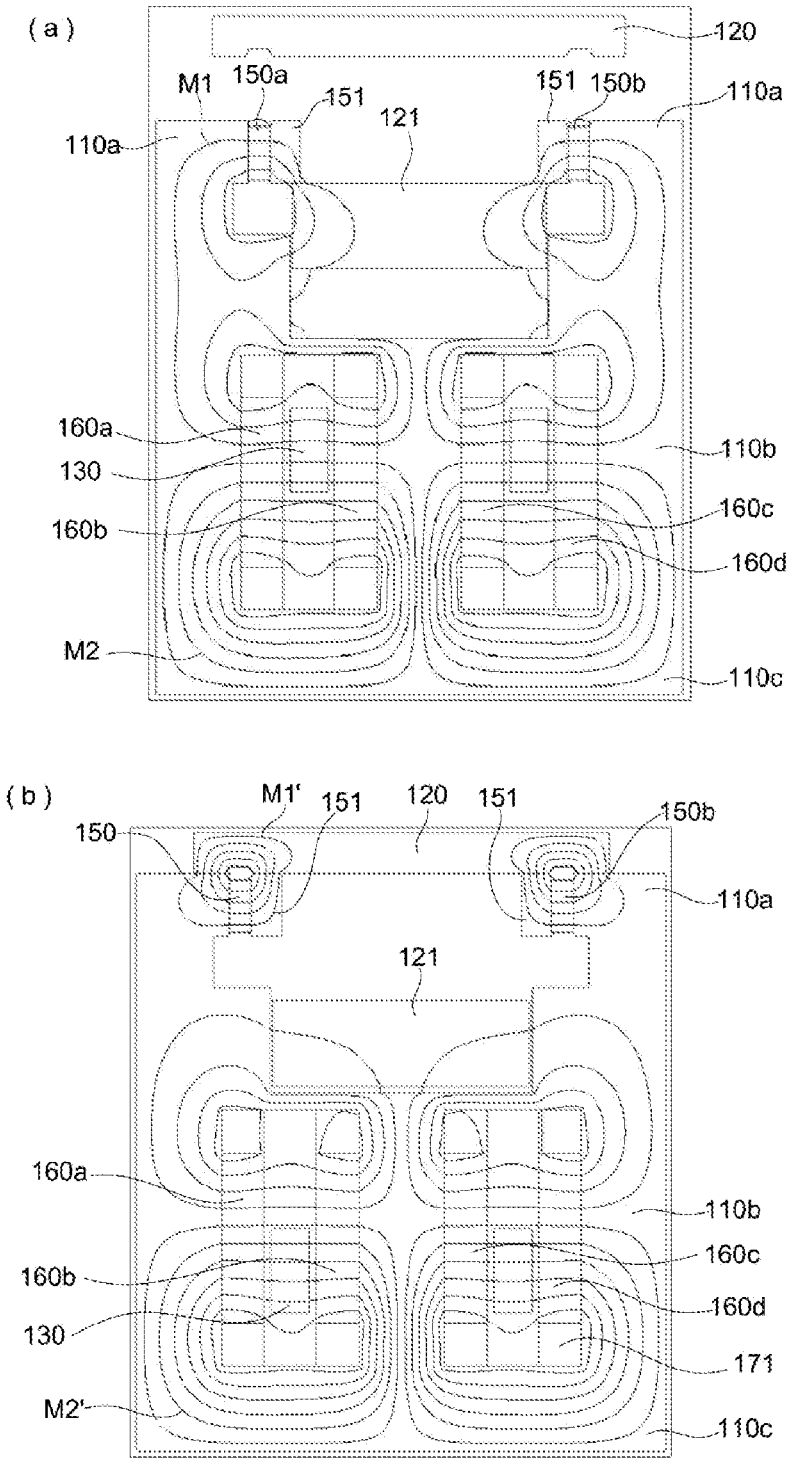
FIG. 4 is an exemplary view showing magnetic force lines according to the operation of the electromagnetic force driving device according to FIG. 1.

FIG. 1 is a perspective view showing a first embodiment of an electromagnetic force driving device according to the present invention, FIG. 2 is an exploded perspective view showing the configuration of the electromagnetic force driving device according to FIG. 1, FIG. 3 is a cross-sectional view showing the structure and operation of the electromagnetic force driving device according to FIG. 1, and FIG. 4 is an exemplary view showing magnetic force lines according to the operation of the electromagnetic force driving device according to FIG. 1.

As shown in FIGS. 1 to 4, an electromagnetic force driving device 100 according to a first embodiment is configured to include a housing 110, a first mover 120, a coil unit 130, a second mover 140, an upper magnet 150 and a lower magnet 160.

The housing 110 is configured to include a first housing 110*a*, a second housing 110*b*, a third housing 110*c*, and a partitioning wall 110*d*. A first mover 120 and an upper magnet 150 are installed in the first housing 110*a*, and a coil unit 130 and a lower magnet 160 are installed in the second housing 110*b*, and the third housing 110*c* is installed under the second housing 110*b*. The partitioning wall 110*d* is installed to separate the first housing 110*a* and the second housing 110*b*, and a second mover penetration hole 113 is perforated for a second mover 140 to pass through. The first to third housings 110*a*, 110*b* and 110*c* and the partitioning wall 110*d* are formed of a magnetic substance.

The first housing 110*a* is a rectangular magnetic substance arranged at the upper portion of the housing 110, which has an open top and a groove unit of a predetermined depth formed in the length direction and is configured to include a first motion path 111*a* in which a portion of the first mover 120 is inserted and rested and an upper magnet installation groove 112 in which the upper magnet 150 is installed.

In addition, the second housing 110*b* is installed under the first housing 110*a* to form a second motion path for moving the coil unit 130 in the vertical direction. The third housing 110*c* is installed under the second housing 110*b* to support the lower magnet 160, a first non-magnetic substance 170 and a second non-magnetic substance 171 installed in the second housing 110*b*, and the second and third housings 110*b* and 110*c* are preferably formed of a magnetic substance.

The first mover 120 is a plate shaped member installed on the top of the first housing 110*a* to be movable in the vertical direction, and a first mover supporting body 121 moving along the first motion path 111*a* of the first housing 110*a* is connected to the first mover 120 through a first mover link 121*a*.

In addition, the first mover 120 is formed of a magnetic substance to form a magnetic field of the upper magnet 150 to maintain a predetermined position.

The coil unit 130 is a configuration installed to penetrate the second housing 110*b* in the lateral direction to generate an electromagnetic force so as to move in a direction perpendicular to the magnetic field of the lower magnet (either upwards or downwards in the figure) by a magnetic flux density generated by the lower magnet 160, a density of the supplied current and a repulsive force of current according to a forward or reverse direction, and it is configured to be wound (wrapped) with a conductive wire in an approximate oval shape so that, for example, current may flow in a forward direction of flowing clockwise from the left to the right or in a reverse direction of flowing counterclockwise from the right to the left in the figure.

The second mover 140 is a pipe shaped member, in which one end is combined with the top of the coil unit 130, and the other end passes through the second mover penetration hole 113 of the partitioning wall 110*d* to be connected to the first mover 120, to operate the first mover 120 to move in the vertical direction according to the vertical movement of the coil unit 130.

The upper magnet 150 is a permanent magnet for providing a magnetic force to maintain the first mover 120 at a predetermined position, which can provide a large holding force with a small size (area or volume), and since the magnet size of the upper magnet 150 can be freely changed, the upper magnet 150 may provide an appropriate holding force to the first mover 120 according to the usage of installation.

In addition, the upper magnet 150 is configured to include a first magnetic substance 151 to form a magnetic circuit together with the first mover 120 or to form a magnetic circuit together with the first mover supporting body 121.

The lower magnet 160 is a permanent magnet arranged in parallel to the second housing 110*b* to form a magnetic field at the coil unit 130, and the lower magnet 160 is configured of a first lower magnet 160*a*, a second lower magnet 160*b*, a third lower magnet 160*c* and a fourth lower magnet 160*d* installed around the coil unit 130 in parallel to each other to form a magnetic field so as to generate a repulsive force for moving the coil unit 130 upwards or downwards according to a direction of current supplied to the coil unit 130.

In addition, the first non-magnetic substance 170 and the second non-magnetic substance 171 are installed above and below the first to fourth lower magnets, respectively, between the first to fourth lower magnets 160*a*, 160*b*, 160*c* and 160*d* and the partitioning wall 110*d* and between the first to fourth lower magnets 160*a*, 160*b*, 160*c* and 160*d* and the third housing 110*c* to form a magnetic path by maintaining a distance, and N poles and S poles of the first to fourth lower magnets 160*a*, 160*b*, 160*c* and 160*d* are sequentially arranged inside the second housing 110*b* centering on the coil unit 130 so that a magnetic field may be formed in a predetermined direction.

If the first to fourth lower magnets 160*a*, 160*b*, 160*c* and 160*d* are arranged as described above and a forward or reverse current flows through the coil unit 130, a force for moving the coil unit 130 in a direction perpendicular to the magnetic field is generated by the Fleming's left hand rule, based on the magnetic density generated by the first to fourth magnets 160*a*, 160*b*, 160*c* and 160*d*, the current density of the coil unit 130 and the repulsive force according to the direction of the current, for example, a force for moving the coil unit 130 downwards is generated in repulsion to the magnetic field M2 formed at an upper portion as shown in FIG. 4(*a*), or a force for moving the coil unit 130 upwards is generated in repulsion to the magnetic field M2' formed at a lower portion as shown in FIG. 4(*b*), and thus the coil unit 130 may move linearly in the longitudinal direction (vertical direction) of the second housing 110*b*.

Meanwhile, the first housing 110*a* is arranged such that the groove unit formed in the length direction is parallel to the length direction of the coil unit 130 of the second housing 110*b*.

Next, the operation procedure of the electromagnetic force driving device 100 according to a first embodiment of the present invention will be described.

(Supply of Forward Current)

When the first mover 120 is positioned at the top dead point protruded above the first housing 110*a*, the first mover 120 maintains a state of being positioned at the top dead point by the magnetic force M1 generated between the upper magnet 150 and the first mover supporting body 121 as shown in FIG. 4(*a*).

Then, if a forward current is supplied to the coil unit 130, the coil unit 130 moves downwards due to the electromagnetic force caused by the electric force generated by the coil unit 130 and the magnetic force M2 generated by the lower magnet 160, and the first mover 120 also moves downwards by the second mover 140 combined with the coil unit 130.

If the forward current supplied to the coil unit 130 is cut off, the magnetic force M1' of FIG. 4(*b*) is generated between the first mover 120 and the upper magnet 150, and thus the first mover 120 is held at the bottom dead point where the first mover 120 is tightly attached to the first housing 110*a*.

(Supply of Reverse Current)

When the first mover 120 is positioned at the bottom dead point where the first mover 120 is tightly attached to the top surface of the first housing 110*a*, the first mover 120 maintains the bottom dead point by the magnetic force M1 generated between the upper magnet 150 and the first mover 120 as shown in FIG. 4(*b*).

Then, if a reverse current is supplied to the coil unit 130, the coil unit 130 moves upwards due to the electromagnetic force caused by the electric force generated by the coil unit 130 and the magnetic force M2' generated by the lower magnet 160, and the first mover 120 also moves upwards by the second mover 140 combined with the coil unit 130.

If the reverse current supplied to the coil unit 130 is cut off, the first mover 120 moves to the top dead point, and the magnetic force M1 of FIG. 4(*a*) is generated between the first mover supporting body 121 and the upper magnet 150 and holds the first mover 120 to maintain the top dead point.

Second Embodiment

Figure 5:
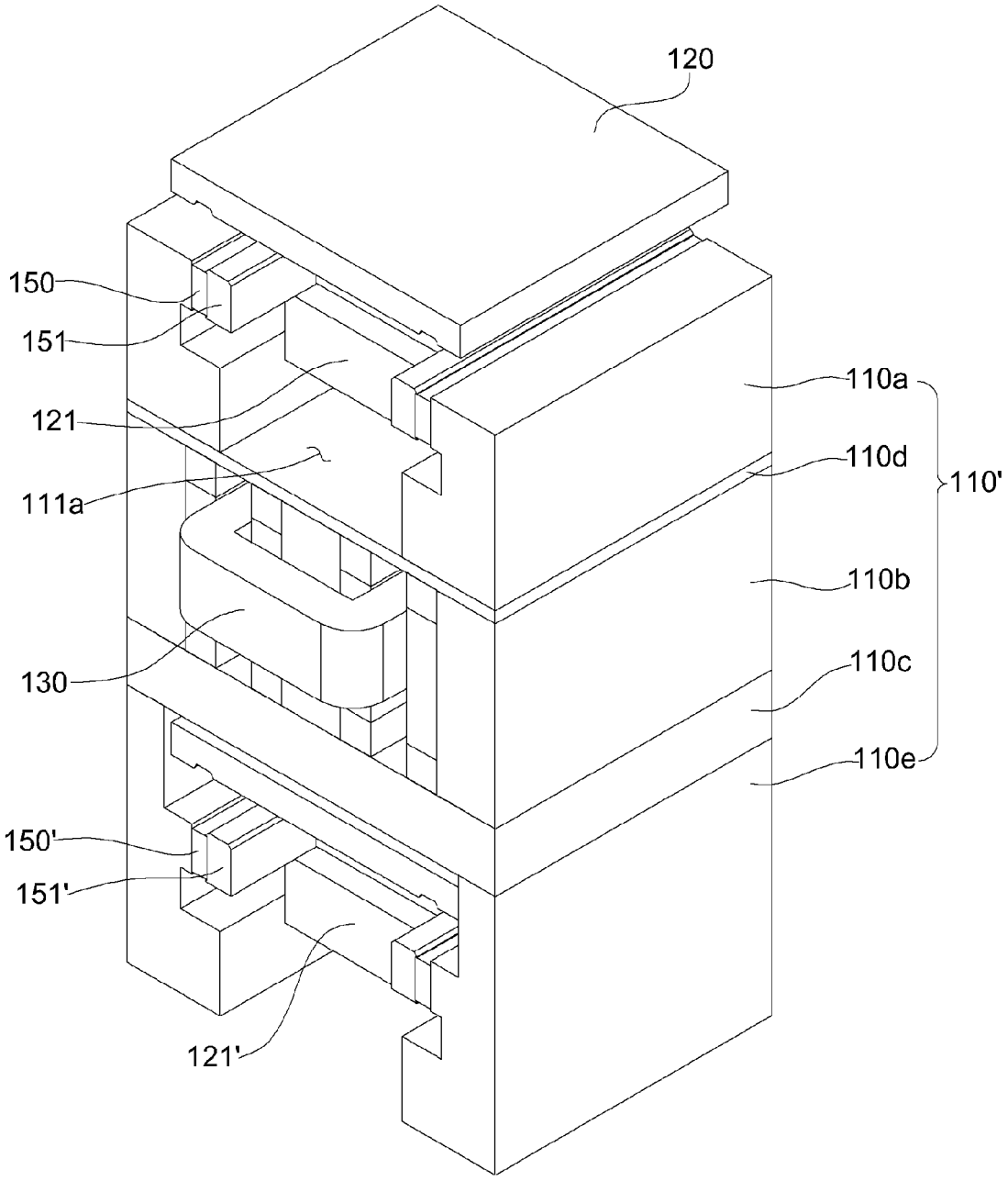
FIG. 5 is a perspective view showing a second embodiment of an electromagnetic force driving device according to the present invention.
Figure 6:
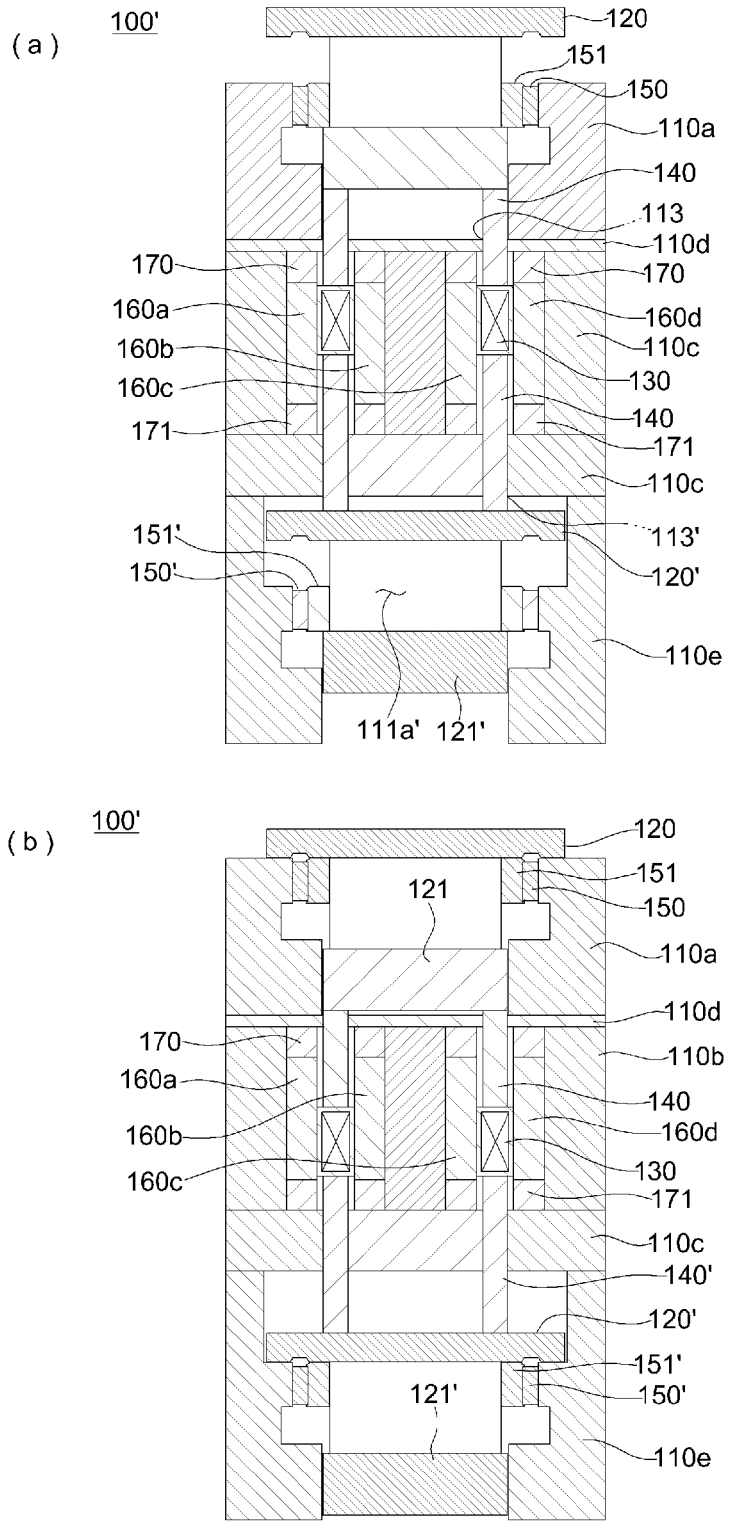
FIG. 6 is a cross-sectional view showing the structure and operation of the electromagnetic force driving device according to FIG. 5.
Figure 7:
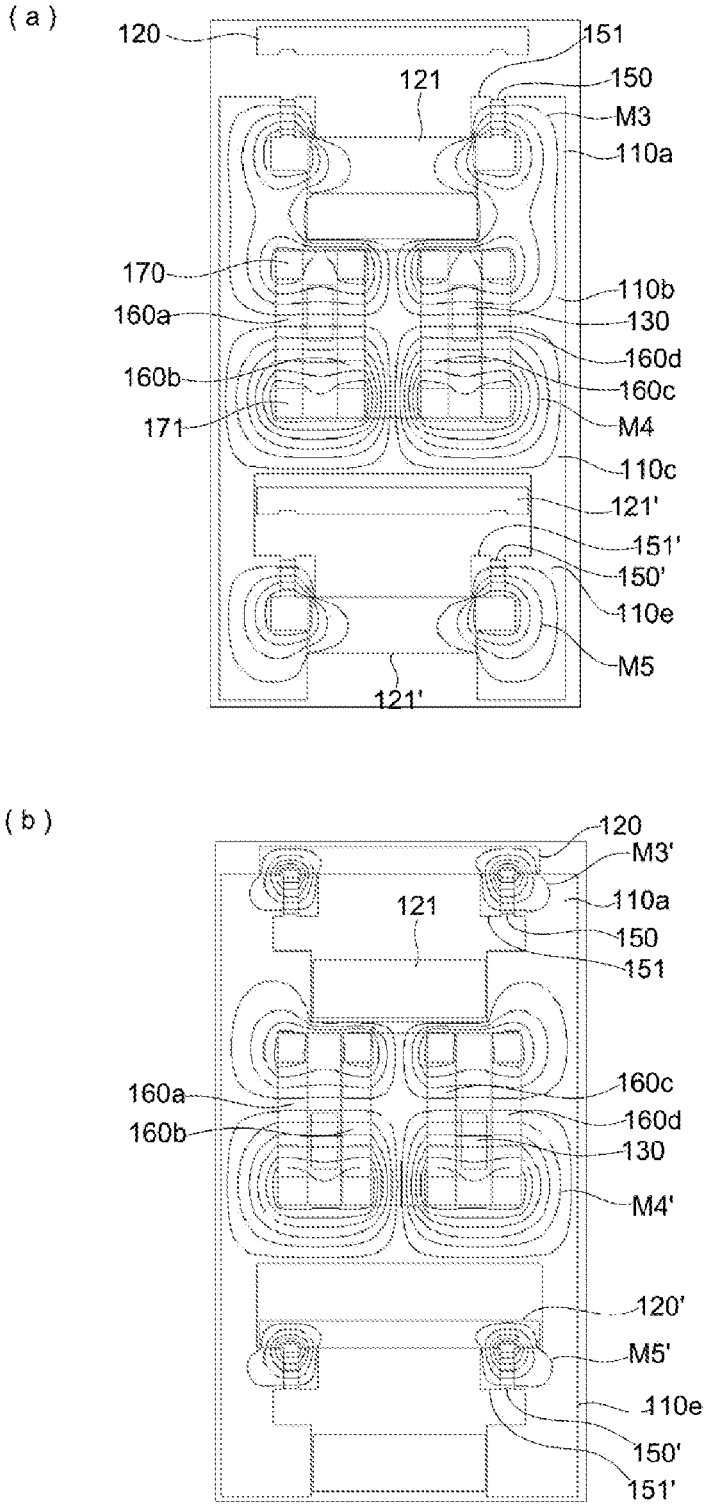
FIG. 7 is an exemplary view showing magnetic force lines according to the operation of the electromagnetic force driving device according to FIG. 5.

FIG. 5 is a perspective view showing a second embodiment of an electromagnetic force driving device according to the present invention, FIG. 6 is a cross-sectional view showing the structure and operation of the electromagnetic force driving device according to FIG. 5, and FIG. 7 is an exemplary view showing magnetic force lines according to the operation of the electromagnetic force driving device according to FIG. 5.

As shown in FIGS. 5 to 7, the electromagnetic force driving device 100' according to a second embodiment is configured to include a housing 110, a first mover 120, a first supporting mover 120', a coil unit 130, a second mover 140, a second supporting mover 140', an upper magnet 150, a supporting magnet 150' and a lower magnet 160.

Among the elements of the electromagnetic force driving device 100' according to the second embodiment, repeated descriptions of the elements the same as those of the first embodiment are omitted, and like numerals are used for like elements.

The housing 110' is configured to include a first housing 110*a*, a second housing 110*b*, a third housing 110*c*, a partitioning wall 110*d*, and a supporting housing 110*e*.

The supporting housing 110*e* is installed under the third housing 110*c*, has an open bottom and a groove unit formed in the length direction, and includes a supporting motion path 111*a'* in which a portion of the first supporting mover 120' is inserted and rested and a supporting magnet installation groove in which the supporting magnet 150' is installed.

The first supporting mover 120' is a plate shaped member installed in the supporting housing 110*e* to be movable in the vertical direction, and a first supporting mover supporting body 121' installed at a lower portion of the supporting housing 110*e* to be movable in the vertical direction and moving along the supporting motion path 111*a'* of the supporting housing 110*e* is connected to the first supporting mover 120' through a first supporting mover link.

In addition, the first supporting mover 120' is formed of a magnetic substance to form a magnetic field of the supporting magnet 150' to maintain a predetermined position.

The second supporting mover 140' is a pipe shaped member, in which one end is combined with the coil unit 130, and the other end passes through the third housing 110*c* to be connected to the first supporting mover 120', to operate the first supporting mover 120' to move in the vertical direction according to the vertical movement of the coil unit 130.

The supporting magnet 150' is a permanent magnet installed in the supporting housing 110*e* to provide a magnetic force for the first supporting mover 120' to maintain a predetermined position, and the supporting magnet 150' has a first supporting magnetic substance 151' installed at one side of the body of the supporting magnet 150' to form a magnetic path together with the first supporting mover 120'.

Meanwhile, the first housing 110*a* and the supporting housing 110*e* are arranged such that the groove units thereof formed in the length direction are parallel to the length direction of the coil unit 130 of the second housing 110*b*.

Next, the operation procedure of the electromagnetic force driving device 100' according to a second embodiment of the present invention will be described.

(Supply of Forward Current)

When the first mover 120 is positioned at the top dead point protruded above the first housing 110*a* and the first supporting mover 120' is positioned at the top dead point after moving toward the top of the supporting housing 110*e*, the first mover 120 maintains a state of being positioned at the top dead point by the magnetic force M3 generated between the upper magnet 150 and the first mover supporting body 121 as shown in FIG. 7(*a*), and the first supporting mover 120' maintains a state of being positioned at the top dead point by the magnetic force M5 generated between the supporting magnet 150' and the first supporting mover supporting body 121'.

Then, if a forward current is supplied to the coil unit 130, the coil unit 130 moves downwards due to the electromagnetic force caused by the electric force generated by the coil unit 130 and the magnetic force M4 generated by the lower magnet 160, and the first mover 120 and the first supporting mover 120' also move downwards by the second mover 140 and the second supporting mover 140' combined with the coil unit 130.

If the forward current supplied to the coil unit 130 is cut off, the magnetic force M3' of FIG. 7(*b*) is generated between the first mover 120 and the upper magnet 150, and thus the first mover 120 is held at the bottom dead point where the first mover 120 is tightly attached to the first housing 110*a*, and the magnetic force M5' is generated between the first supporting mover 120' and the supporting magnet 150', and thus the first supporting mover 120' is held at the bottom dead point where the first supporting mover 120' is tightly attached to the supporting housing 110*e*.

(Supply of Reverse Current)

When the first mover 120 is positioned at the bottom dead point where the first mover 120 is tightly attached to the top surface of the first housing 110*a* and the first supporting mover 120' is positioned at the bottom dead point where the first supporting mover 120' is tightly attached to the supporting housing 110*e*, the first mover 120 maintains the bottom dead point by the magnetic force M3' generated between the upper magnet 150 and the first mover 120 as shown in FIG. 7(*b*), and the first supporting mover 120' maintains the bottom dead point by the magnetic force M5' generated between the supporting magnet 150' and the first supporting mover 120'.

Then, if a reverse current is supplied to the coil unit 130, the coil unit 130 moves upwards due to the electromagnetic force caused by the electric force generated by the coil unit 130 and the magnetic force M4' generated by the lower magnet 160, and the first mover 120 and the first supporting mover 120' also move upwards by the second mover 140 and the second supporting mover 140' combined with the coil unit 130.

If the reverse current supplied to the coil unit 130 is cut off, the first mover 120 and the first supporting mover 120' move to the top dead point, and the magnetic force M3 of FIG. 7(*a*) is generated between the first mover supporting body 121 and the upper magnet 150 and holds the first mover 120 to maintain the top dead point, and the magnetic force M5 is generated between the first supporting mover supporting body 121' and the supporting magnet 150' and holds the first supporting mover 120' to maintain the top dead point.

Third Embodiment

Figure 8:
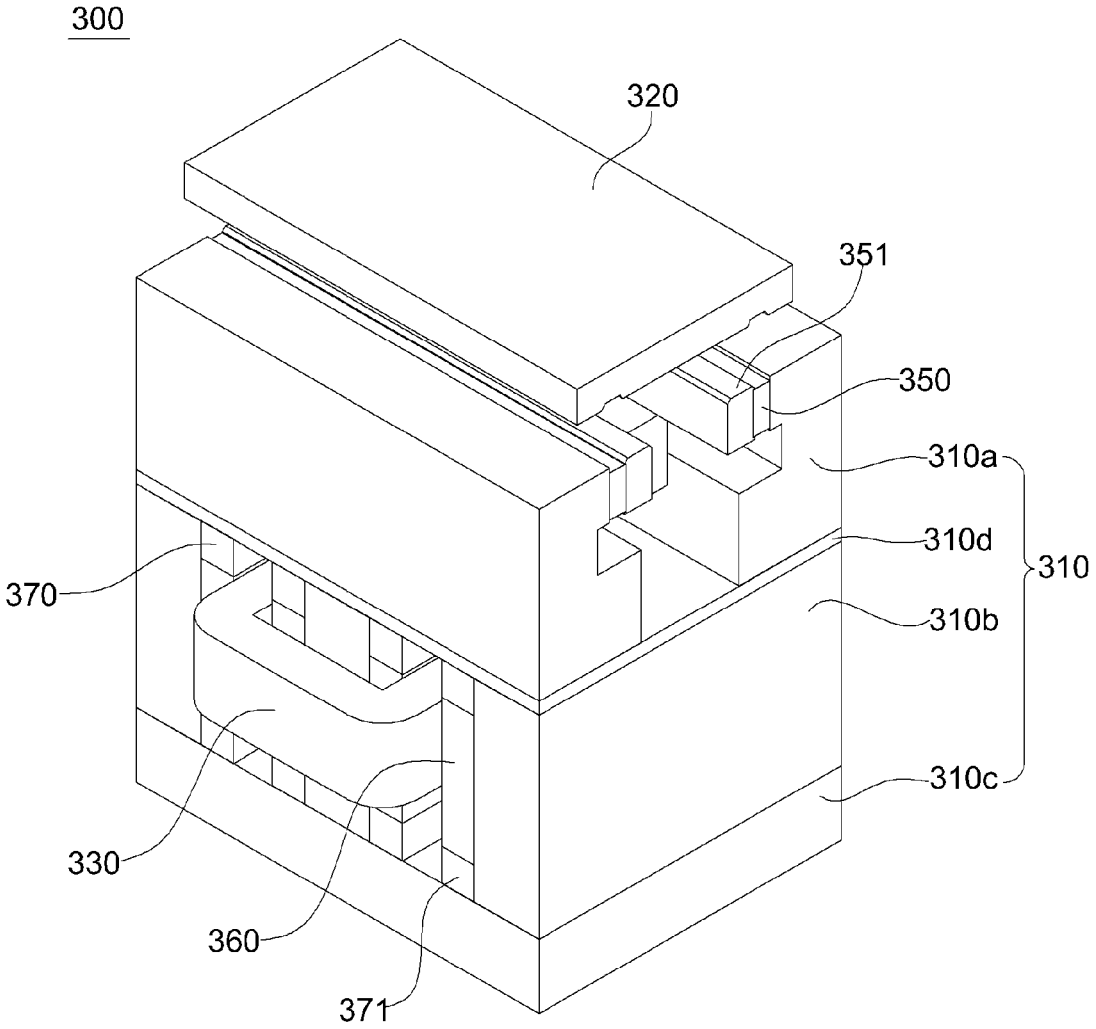
FIG. 8 is a perspective view showing a third embodiment of an electromagnetic force driving device according to the present invention.
Figure 9:
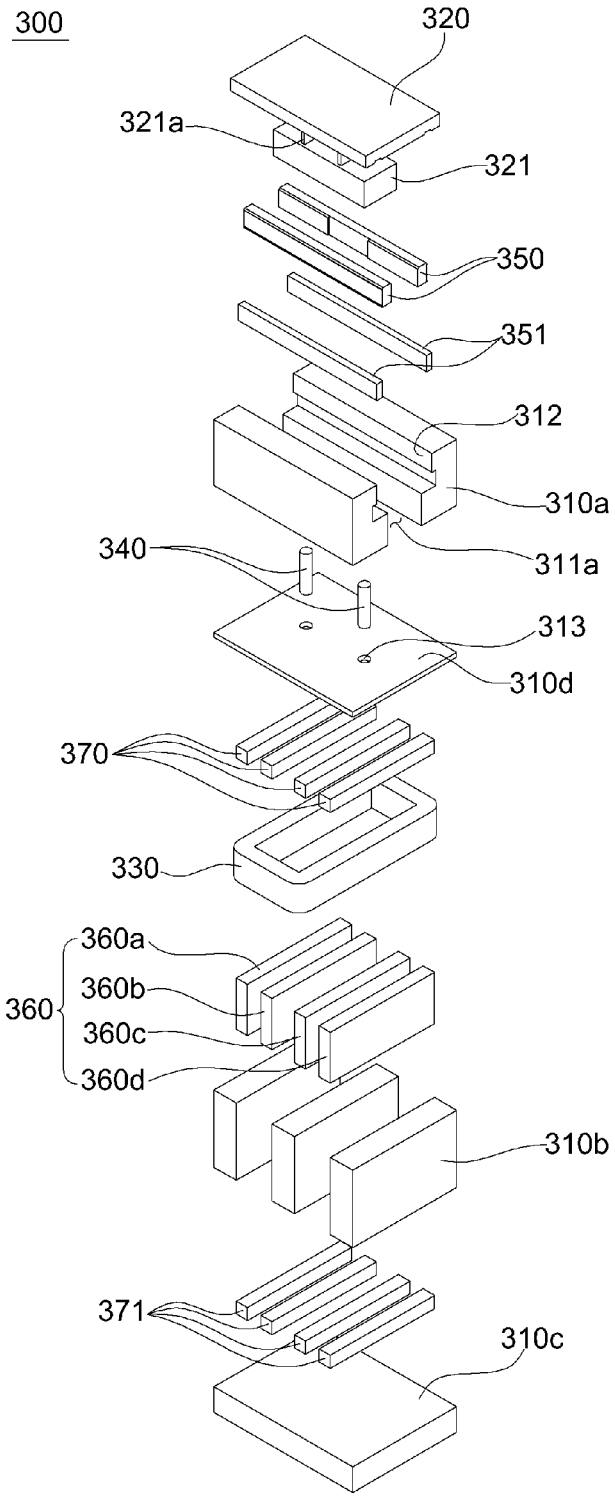
FIG. 9 is an exploded perspective view showing the configuration of the electromagnetic force driving device according to FIG. 8.
Figure 10:
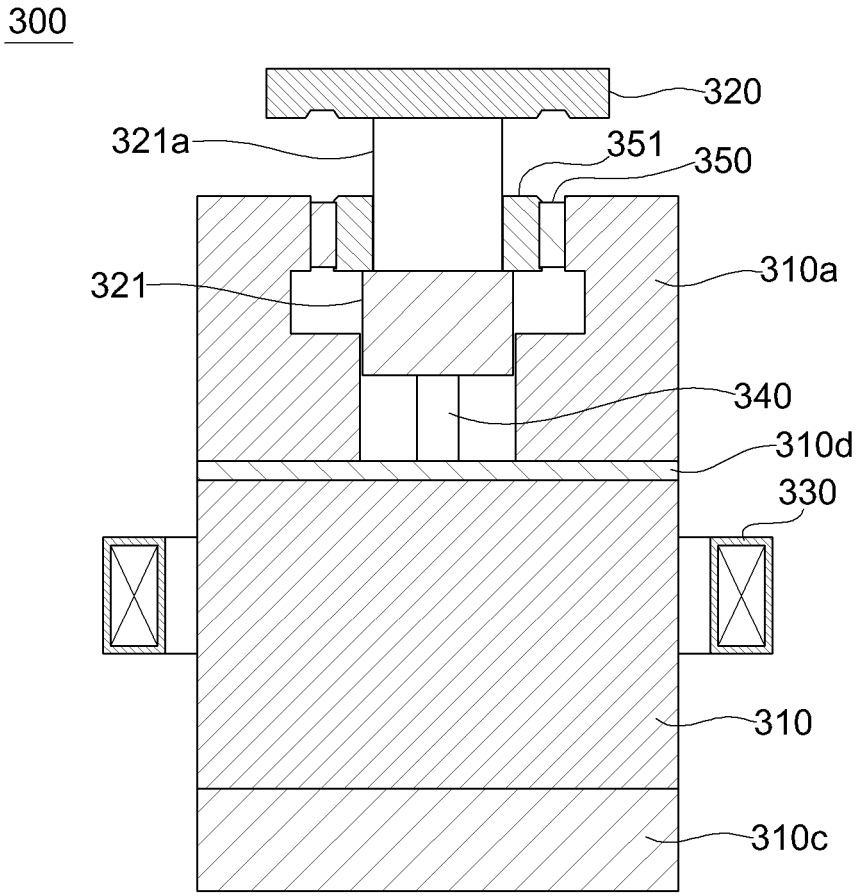
FIG. 10 is a cross-sectional view showing the structure of the electromagnetic force driving device according to FIG. 8.

FIG. 8 is a perspective view showing a third embodiment of an electromagnetic force driving device according to the present invention, FIG. 9 is an exploded perspective view showing the configuration of the electromagnetic force driving device according to FIG. 8, and FIG. 10 is a cross-sectional view showing the structure of the electromagnetic force driving device according to FIG. 8.

As shown in FIGS. 8 to 10, an electromagnetic force driving device 300 according to a third embodiment is configured to include a housing 310, a first mover 320, a coil unit 330, a second mover 340, an upper magnet 350 and a lower magnet 360.

The housing 310 is configured to include a first housing 310*a*, a second housing 310*b*, a third housing 310*c*, and a partitioning wall 310*d*. A first mover 320 and an upper magnet 350 are installed in the first housing 310*a*, and a coil unit 330 and a lower magnet 360 are installed in the second housing 310*b*, and the third housing 310*c* is installed under the second housing 310*b*. The partitioning wall 310*d* is installed to separate the first housing 310*a* and the second housing 310*b*, and a second mover penetration hole 313 is perforated for a second mover 340 to pass through. The first to third housings 310*a*, 310*b* and 310*c* and the partitioning wall 310*d* are formed of a magnetic substance.

The first housing 310*a* is a rectangular magnetic substance arranged at the upper portion of the housing 310, which has an open top and a groove unit of a predetermined depth formed in the length direction and is configured to include a first motion path 311*a* in which a portion of the first mover 320 is inserted and rested and an upper magnet installation groove 312 in which the upper magnet 350 is installed.

In addition, the second housing 310*b* is installed under the first housing 310*a* to form a second motion path for moving the coil unit 330 in the vertical direction, and the third housing 310*c* is installed under the second housing 310*b* to support the lower magnet 360, a first non-magnetic substance 370 and a second non-magnetic substance 371 installed in the second housing 310*b*. The second and third housings 310*b* and 310*c* are preferably formed of a magnetic substance.

The difference between the electromagnetic force driving device 300 according to the third embodiment and the electromagnetic force driving device 100 according to the first embodiment is installation directions of the first and second housings 310*a* and 310*b*, and the first housing 310*a* according to the third embodiment is arranged such that the groove unit formed in the length direction is parallel to the length direction of the coil unit 330 of the second housing 310*b*.

The first mover 320 is a plate shaped member installed on the top of the first housing 310*a* to be movable in the vertical direction, and a first mover supporting body 321 moving along the first motion path 311*a* of the first housing 310*a* is connected to the first mover 320 through a first mover link 321*a*.

In addition, the first mover 320 is formed of a magnetic substance to form a magnetic field of the upper magnet 350 to maintain a predetermined position.

The coil unit 330 is installed to penetrate the second housing 310*b* in the lateral direction and generates an electromagnetic force so as to move in a direction perpendicular to the magnetic field of the lower magnet (either upwards or downwards in the figure) by a magnetic flux density generated by the lower magnet 360, a density of the supplied current and a repulsive force of the current according to a forward or reverse direction.

The second mover 340 is a pipe shaped member, in which one end is combined with the top of the coil unit 330, and the other end passes through the second mover penetration hole 313 of the partitioning wall 310*d* to be connected to the first mover 320, to operate the first mover 320 to move in the vertical direction according to the vertical movement of the coil unit 330.

The upper magnet 350 is a permanent magnet for providing a magnetic force to maintain the first mover 320 at a predetermined position, and the upper magnet 350 is configured to include a first magnetic substance 351 to form a magnetic circuit together with the first mover 320 or to form a magnetic circuit together with the first mover supporting body 321.

The lower magnet 360 is a permanent magnet arranged in parallel to the second housing 310*b* to form a magnetic field at the coil unit 330, and the lower magnet 360 is configured of a first lower magnet 360*a*, a second lower magnet 360*b*, a third lower magnet 360*c* and a fourth lower magnet 360*d* and forms a magnetic field so as to generate a repulsive force for moving the coil unit 330 upwards or downwards according to a direction of current supplied to the coil unit 330.

In addition, the first non-magnetic substance 370 and the second non-magnetic substance 371 are installed above and below the first to fourth lower magnets, respectively, between the first to fourth lower magnets 360*a*, 360*b*, 360*c* and 360*d* and the partitioning wall 310*d* and between the first to fourth lower magnets 360*a*, 360*b*, 360*c* and 360*d* and the third housing 310*c* to form a magnetic path by maintaining a distance, and N poles and S poles of the first to fourth lower magnets 360*a*, 360*b*, 360*c* and 360*d* are sequentially arranged inside the second housing 310*b* centering on the coil unit 330 so that a magnetic field may be formed in a predetermined direction.

Fourth Embodiment

Figure 11:
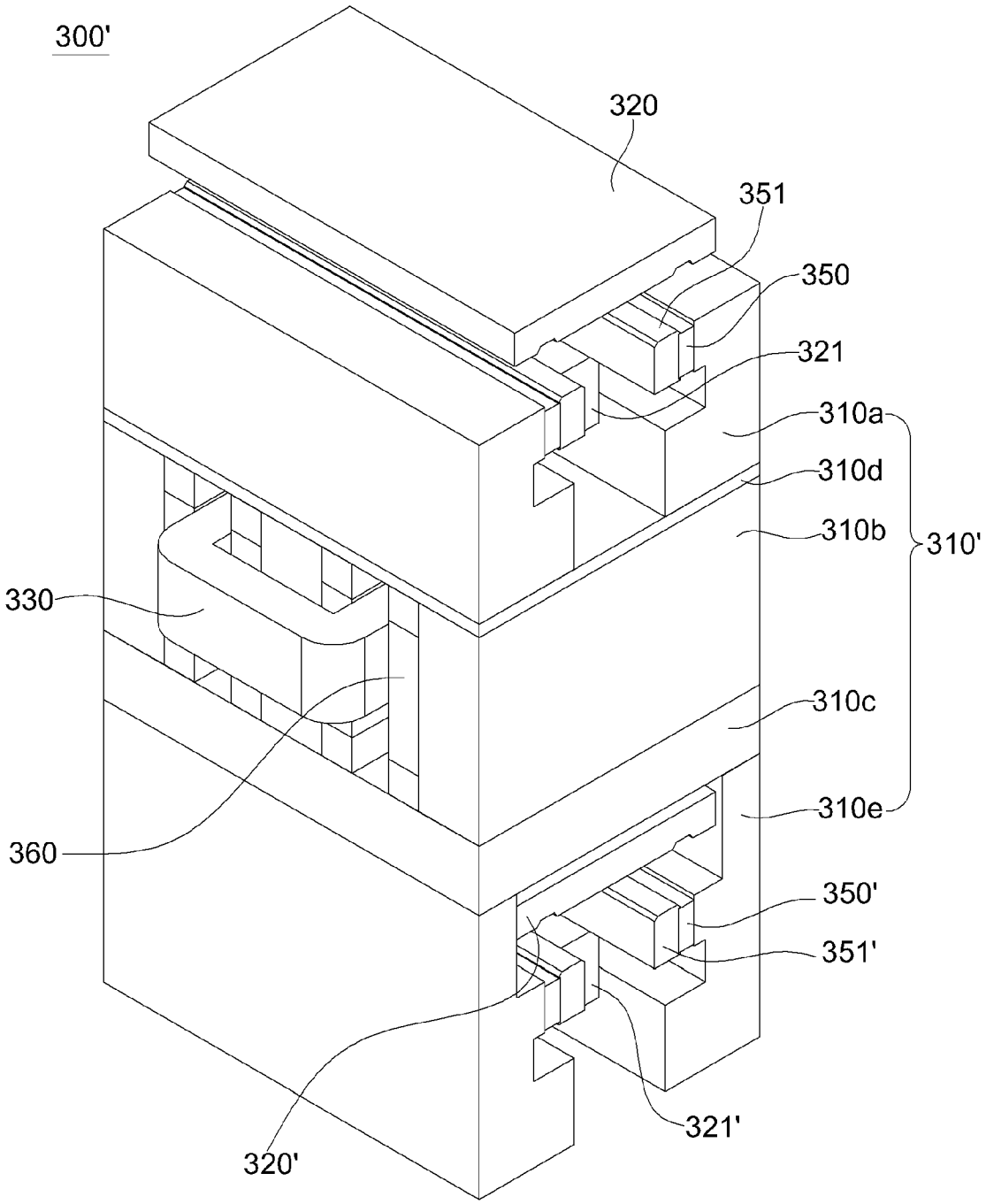
FIG. 11 is a perspective view showing a fourth embodiment of an electromagnetic force driving device according to the present invention.
Figure 12:
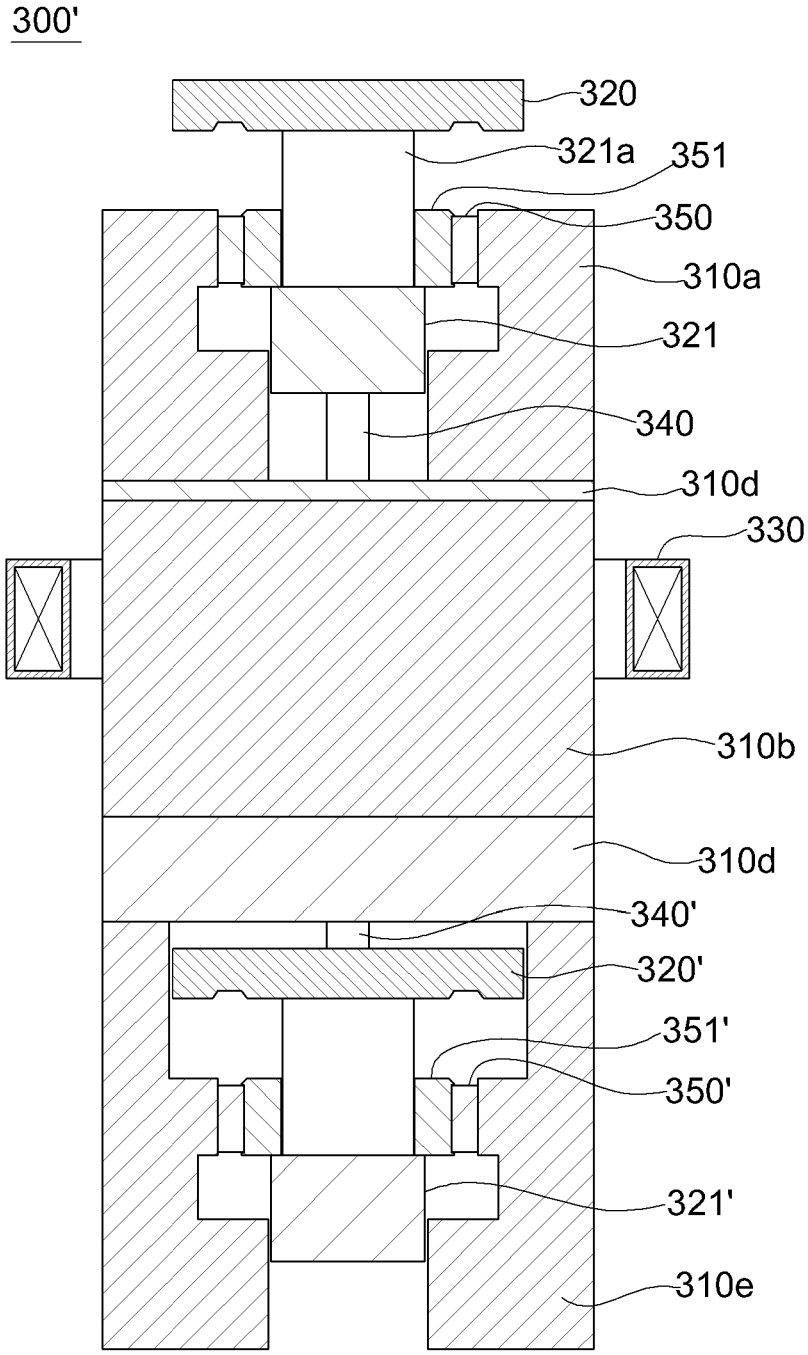
FIG. 12 is a cross-sectional view showing the structure of the electromagnetic force driving device according to FIG. 11.

FIG. 11 is a perspective view showing a fourth embodiment of an electromagnetic force driving device according to the present invention, and FIG. 12 is a cross-sectional view showing the structure of the electromagnetic force driving device according to FIG. 11.

As shown in FIGS. 10 and 11, the electromagnetic force driving device 300' according to a fourth embodiment is configured to include a housing 310', a first mover 320, a first supporting mover 320', a coil unit 330, a second mover 340, a second supporting mover 340', an upper magnet 350, a supporting magnet 350' and a lower magnet 360.

Among the elements of the electromagnetic force driving device 300' according to the fourth embodiment, repeated descriptions of the elements the same as those of the third embodiment are omitted, and like numerals are used for like elements.

The housing 310' is configured to include a first housing 310*a*, a second housing 310*b*, a third housing 310*c*, a partitioning wall 310*d*, and a supporting housing 310*e*.

The supporting housing 310*e* is installed under the third housing 310*c*, has an open bottom and a groove unit formed in the length direction, and includes a supporting motion path in which a portion of the first supporting mover 320' is inserted and rested and a supporting magnet installation groove in which the supporting magnet 350' is installed.

The difference between the electromagnetic force driving device 300' according to the fourth embodiment and the electromagnetic force driving device 100' according to the second embodiment is installation directions of the first and supporting housings 310*a* and 310*e* and the second housing 310*b*, and the first housing 310*a* and the supporting housing 310*e* according to the fourth embodiment are arranged such that the groove units formed in the length direction are parallel to the length direction of the coil unit 330 of the second housing 310*b*.

The first supporting mover 320' is a plate shaped member installed in the supporting housing 310*e* to be movable in the vertical direction, and a first supporting mover supporting body 321' installed at a lower portion of the supporting housing 310*e* to be movable in the vertical direction and moving along the supporting motion path of the supporting housing 310*e* is connected to the first supporting mover 320' through a first supporting mover link.

In addition, the first supporting mover 320' is formed of a magnetic substance to form a magnetic field of the supporting magnet 350' to maintain a predetermined position.

The second supporting mover 340' is a pipe shaped member, in which one end is combined with the coil unit 330, and the other end passes through the third housing 310*c* to be connected to the first supporting mover 320', to operate the first supporting mover 320' to move in the vertical direction according to the vertical movement of the coil unit 330.

The supporting magnet 350' is a permanent magnet installed in the supporting housing 310*e* to provide a magnetic force for the first supporting mover 320' to maintain a predetermined position, and the supporting magnet 350' has a first supporting magnetic substance 351' installed at one side of the body of the supporting magnet 350' to form a magnetic path together with the first supporting mover 320'.

Accordingly, when an error occurs in a power distribution and transmission line, it can be promptly cut off, and the overall weight and size can be reduced by simplifying the structure of the electromagnetic force driving device by combining a magnetic substance and a coil unit through a connection pin inside thereof, and, in addition, electromagnetic characteristics and a holding force can be easily changed by forming independent motion paths for moving the mover and the coil unit.

While the present invention has been described with reference to the particular illustrative embodiments, it is not to be restricted by the embodiments but only by the appended claims. It is to be appreciated that those skilled in the art can change or modify the embodiments without departing from the scope and spirit of the present invention.

In addition, in the process of describing embodiments of the present invention, thickness of the lines and sizes of the elements shown in the figures may be exaggerated for clarity and convenience of the descriptions, and the terms described above are terminologies defined considering the functions of the present invention, and since meanings thereof may vary depending on the intention of an operator or common practices, definitions of the terms should be made based on the overall contents of this specification.

What is claimed is:

1. An electromagnetic force driving device comprising:

a housing or including a first housing having an open top and a groove unit formed in a length direction, a second housing installed under the first housing, a third housing installed under the second housing, and a partitioning wall for partitioning the first and second housings and;

a first mover installed on a top of the first housing to be movable in a vertical direction;

a coil unit installed at a lower portion of the second housing so as to move either upwards or downwards by a repulsive force according to a direction of current supplied in a forward direction or a reverse direction;

a second mover, one end of which is combined with the coil unit, and the other end of which passes through the partitioning wall to be connected to the first mover, to operate the first mover according to a movement of the coil unit;

an upper magnet installed in the first housing to provide a magnetic force for the first mover to maintain a predetermined position; and a lower magnet arranged in the second housing in parallel to form a magnetic field at the coil unit.

2. The device according to claim 1, wherein the first housing includes a first motion path formed in the length direction to have a predetermined depth so that a portion of the first mover may be inserted and rested and an upper magnet installation groove in which the upper magnet is installed.

3. The device according to claim 1, wherein the upper magnet has a first magnetic substance installed at one side of a body of the upper magnet to form a magnetic path together with the first mover.

4. The device according to claim 1, wherein the second housing includes:

a first non-magnetic substance installed between the partitioning wall and the lower magnet; and a second non-magnetic substance installed between the lower magnet and the third housing.

5. The device according to claim 1, further comprising:

a supporting housing installed at a lower portion of the housing and having an open bottom and a groove unit formed in a length direction;

a first supporting mover installed in the supporting housing to be movable in a vertical direction;

a second supporting mover, one end of which is combined with the coil unit, and the other end of which passes through the third housing to be connected to the first supporting mover, to operate the first supporting mover according to a movement of the coil unit; and a supporting magnet installed in the supporting housing to provide a magnetic force for the first supporting mover to maintain a predetermined position.

6. The device according to claim 5, wherein the supporting magnet further includes a first supporting magnetic substance installed at one side of a body of the supporting magnet to form a magnetic path together with the first supporting mover.

7. The device according to claim 5, wherein the first housing and the supporting housing are arranged such that the grooves thereof formed in the length direction are parallel or perpendicular to the length direction of the coil unit of the second housing.

* * * * *